US006000684A

United States Patent [19]

Pasch et al.

[11] Patent Number: 6,000,684

[45] Date of Patent: Dec. 14, 1999

[54] EVAPORATIVE WICKING PAD

[75] Inventors: Roger M. Pasch, Sun Prairie; Steven H. Jero, Madison, both of Wis.

[73] Assignee: Research Products Corporation, Madison, Wis.

[21] Appl. No.: 08/881,454

[22] Filed: Jun. 24, 1997

[51] Int. Cl.[6] ..... B01F 3/04

[52] U.S. Cl. ..... 261/104; 261/107

[58] Field of Search ..... 261/94, 99, 100, 261/103, 104, 106, 107, DIG. 15, DIG. 41

[56] References Cited

U.S. PATENT DOCUMENTS

| | | | |
|---|---|---|---|
| 796,557 | 8/1905 | Bockoven | 261/107 |
| 1,727,658 | 9/1929 | Matteson | 261/104 |
| 1,842,489 | 1/1932 | Patridge | 261/104 |
| 2,637,540 | 5/1953 | Rowe | 261/94 |
| 2,904,258 | 9/1959 | Miller, Jr. | 261/104 |
| 2,955,064 | 10/1960 | Frohmader | 261/94 |
| 3,092,442 | 6/1963 | Shoemaker | 261/104 |
| 4,338,266 | 7/1982 | Flower | 261/94 |
| 5,207,020 | 5/1993 | Aslam et al. | 47/9 |
| 5,374,381 | 12/1994 | Schuld et al. | 261/106 |
| 5,500,271 | 3/1996 | Pasch et al. | 428/135 |

*Primary Examiner*—C. Scott Bushey
*Attorney, Agent, or Firm*—Andrus, Sceales, Starke & Sawall

[57] ABSTRACT

A gas-pervious, liquid-gas contact pad comprises a reticulate body of water-permeable or wettable material having a large area of surfaces exposed for humidification purposes or the like. A plurality of slit and expanded sheets of wicking paper are connected in superposed and alternating relationship with a plurality of slit and expanded sheets of water-absorbent or wettable kraft paper to form a self-supporting, laminated evaporative element.

18 Claims, 2 Drawing Sheets

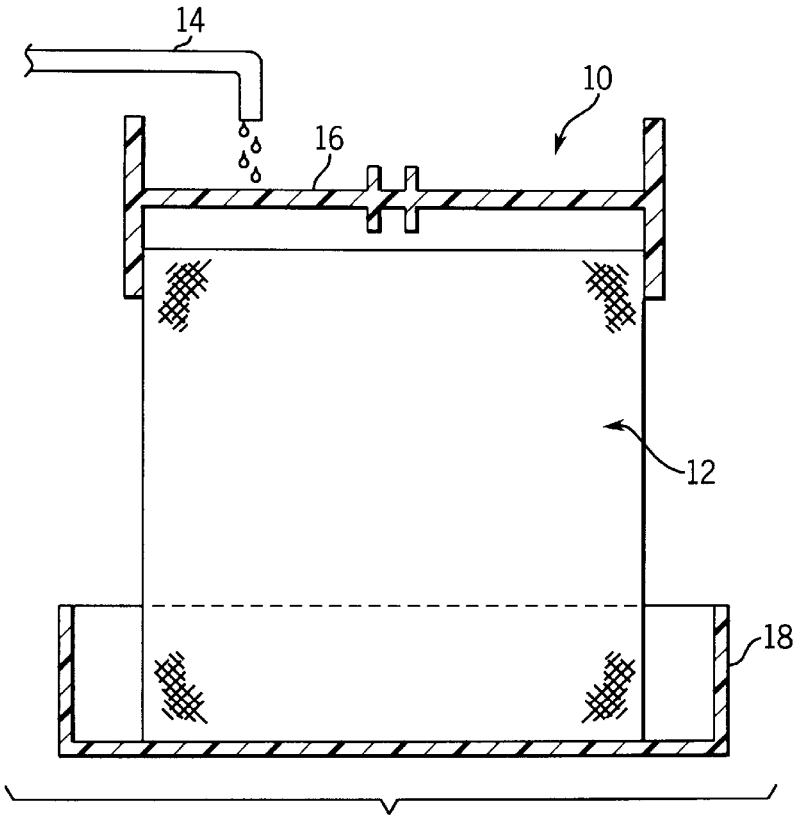
FIG. 1
FIG. 2
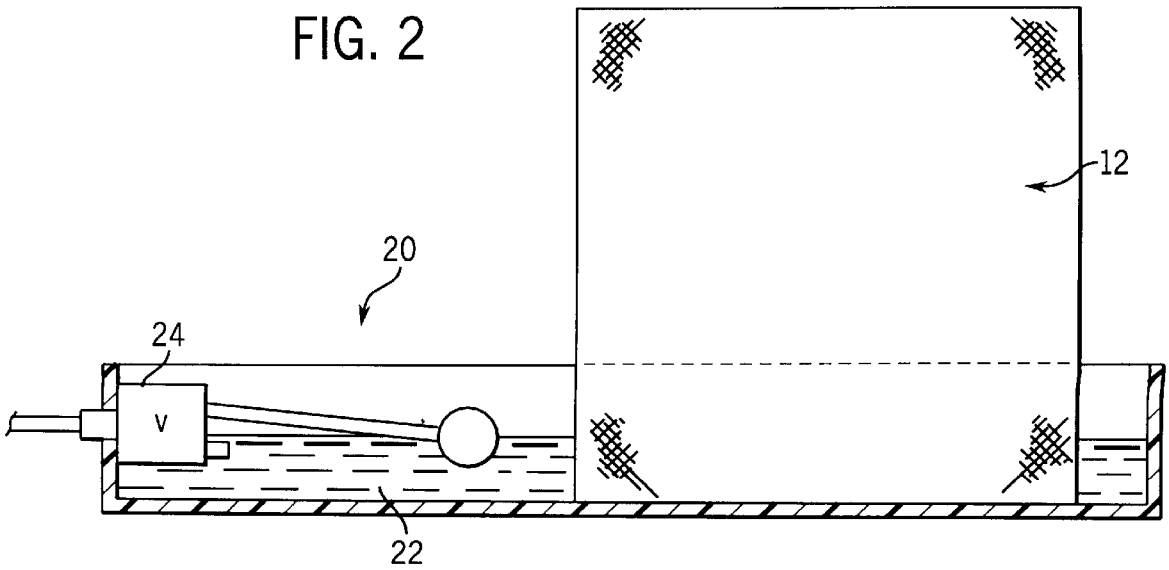

EVAPORATIVE WICKING PAD

FIELD OF THE INVENTION

This invention relates broadly to a water wicking pad for contacting large surfaces of a liquid, such as water, with a gas, such as air, for the purpose, for example, of humidifying and/or cooling air. More particularly, the invention pertains to an evaporative element which not only exhibits an improved evaporative efficiency, but maintains the structural integrity of the evaporative element.

BACKGROUND AND SUMMARY OF THE INVENTION

The humidification of dry air normally occurring in buildings during the winter heating season, and the cooling of hot summer air in arid areas by the evaporation of water thereinto, depends upon the efficient evaporation of water from the continuously wetted surfaces of an evaporative element or pad as, for example, an interstitial body having extensive surfaces to provide a large area of contact of the air with water. The air to be humidified or cooled is forced through the openings of the element where it contacts the wet baffles or fibers of which the evaporative element is composed. Exposure of relatively large water surfaces in this way results in the evaporation of large amounts of the water.

Regardless of the particular purpose for bringing the gas and liquid into contact with each other, it is always desirable in this type of apparatus to expose the largest possible liquid surface to the gas. For a given gross surface of the structure of an evaporative element, evaporation efficiency depends upon the proportion of the surface that is kept continuously wetted so that the largest possible surface of the liquid to be evaporated will continuously be exposed to the gas for evaporation. The invention is directed to this particular aspect of evaporator efficiency.

Many types of evaporative cooling and humidifying devices have been developed which utilize a gas-liquid contact unit of some sort held in position by any one of a number of means, which contact unit is water wetted by gravity feed or liquid immersion, and through which air is forced by a fan or the like.

U.S. Pat. No. 2,637,540, assigned to a common assignee, discloses such a device wherein a gas-liquid contact unit is positioned in a suitable frame. Water drips down onto the unit from a gutter-like trough and spreads therethrough. A fan forces air through the unit for cooling and humidifying purposes. Any water which drips from the bottom of the contact unit may be collected in a sump or the like and recirculated, if desired.

A number of different pad constructions are disclosed in that patent. Basically, the pad comprises a plurality of superposed, expanded sheets of water-absorbent character, the sheets being formed by cutting spaced, staggered slits and then expanding the sheet transversely of the slit length to form webs or baffles separated by openings. The sheets may be made of a water-absorbent, unbleached kraft paper which may be impregnated with a small amount of water resistant substance to improve its wet strength.

Pads constructed from expanded paper so treated have been marketed successfully by the inventor's assignee as well as other manufacturers for a number of years. These water-absorbent pads are sometimes reinforced by a sheet or sheets of generally flexible, non-absorbent material. For example, metal screening or expanded metal or plastic sheets may be placed between the superposed paper layers or on the outer faces thereof. Stitching, penetrating spikes, bonding or other means may be used to hold the several sheets of the flexible gas-liquid contact unit together.

Unfortunately, it has been found that while the non-absorbent supporting reinforcement components prevent sagging or bowing of the saturated kraft paper components in the evaporative element, their non-wicking ability affects the evaporative efficiency of the composite wicking pad.

The present invention is based on the discovery that a gas-liquid contact pad may be fabricated so that the evaporative efficiency of the pad is substantially increased, while still maintaining the desired dimensional stability and structural integrity properties. This is accomplished by alternating layers of slit and expanded water-absorbent or wettable rigidifying material, such as kraft paper, with layers of slit and expanded wicking material.

It is a principal object of the invention to provide a combination paper wicking pad having an upgraded evaporative efficiency.

It is another object of the invention to provide a liquid-gas contact pad having a substantially rigid and self-supporting structure whose inert strength and integrity is not impaired by long, continuous exposure to liquid.

It is a further object of the invention to provide a water-absorbent element which channels more water to and is more uniformly wetted in all areas of the element.

Still another aspect of the invention is to provide a more efficient evaporative element produced with a price reduction with no expected loss in performance.

Moreover, another object of the invention is to provide a hybrid kraft paper and wicking paper lamination which possesses greater dimensional stability than prior art liquid-gas contact pads.

It is also an object of the invention to provide a humidifier pad having high water absorption and wicking behavior.

It is an important object of the invention to provide a method of substantially increasing the evaporative efficiency of an evaporative pad formed from two different types of slit and expanded water-absorbent or wettable paper.

It is a related object of the invention to provide a method of making an evaporative wicking pad by adhesively securing overlying layers of slit and expanded water-absorbent paper.

In one aspect of the invention, a gas pervious liquid-gas contact pad comprises a reticulate body of wettable material having a large area of surfaces exposed. The contact pad comprises a plurality of slit and expanded sheets of wicking material, and a plurality of slit and expanded sheets of wettable kraft material. An arrangement is provided for connecting the sheets of the wicking material and the wettable kraft material in superposed and alternating relationship with one another to define a laminated, self-supporting, evaporative element. In the preferred embodiment, the composition of the wicking material is substantially 55% alpha bleached soft woods, 20% bleached soft woods and 25% bleached hard woods. The composition of the kraft material is substantially 47% soft woods and 53% hard woods. The basis weight of the wicking material is approximately 70 lbs. while the basis weight of the kraft material is approximately 41 lbs. or 120 lbs. The wicking material has a Klemm strip rise of about 100 millimeters per 2 minutes while a 3% resin-impregnated kraft material has a Klemm strip rise of 22 millimeters per 2 minutes, and a 15% resin-impregnated kraft material has a Klemm strip rise of 34 millimeters per 2 minutes.

In another aspect of the invention, an evaporative element for a humidifier or the like comprises a series of stacked layers of slit and expanded wicking paper, each of the layers of the wicking paper having a first evaporative efficiency, and a series of stacked layers of slit and expanded wettable kraft paper, each of the layers of kraft paper having a second evaporative efficiency. An adhesive arrangement is provided for securing the layers of wicking paper and wettable kraft paper together in continuous overlying and alternating relationship with one another to define a laminated evaporative element having a combined evaporative efficiency which is substantially greater than the average of the first evaporative efficiency and the second evaporative efficiency.

The invention also contemplates a method of substantially increasing the evaporative efficiency of an evaporative contact pad formed from a series of stacked layers of slit and expanded wettable rigidifying paper. The method comprises the step of securing the layers of rigidifying paper in contiguous, overlying and alternating relationship with a series of stacked layers of slit and expanded wicking paper to define a self-supporting, laminated evaporative contact pad.

The invention further contemplates a method of making an evaporative wicking pad comprising the steps of: slitting and expanding a series of layers of wicking material; slitting and expanding a series of layers of wettable kraft material; and securing the layers of wicking material and the layers of kraft material in contiguous, overlying and alternating relationship with one another to define a laminated evaporative wicking pad.

BRIEF DESCRIPTION OF THE DRAWINGS

The invention will become better understood by reference to the following detailed description of the preferred exemplary embodiment when read in conjunction with the appended drawing, wherein like numerals denote like elements, and:

FIG. 1 is an elevational view of a gravity fed humidifier employing an evaporative wicking pad embodying the present invention;

FIG. 2 is an elevational view of a wick-up type humidifier also employing an evaporative wicking pad embodying the present invention;

DETAILED DESCRIPTION OF THE INVENTION

Figure 3:
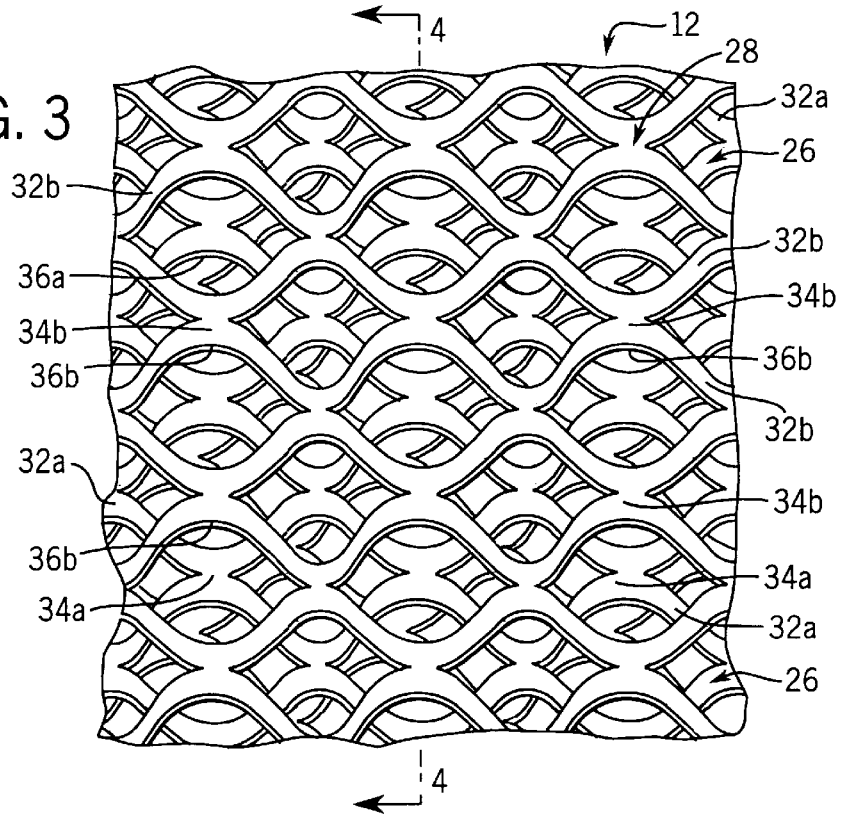
FIG. 3 is a detail plan view of the evaporative wicking pad of the invention.
Figure 4:
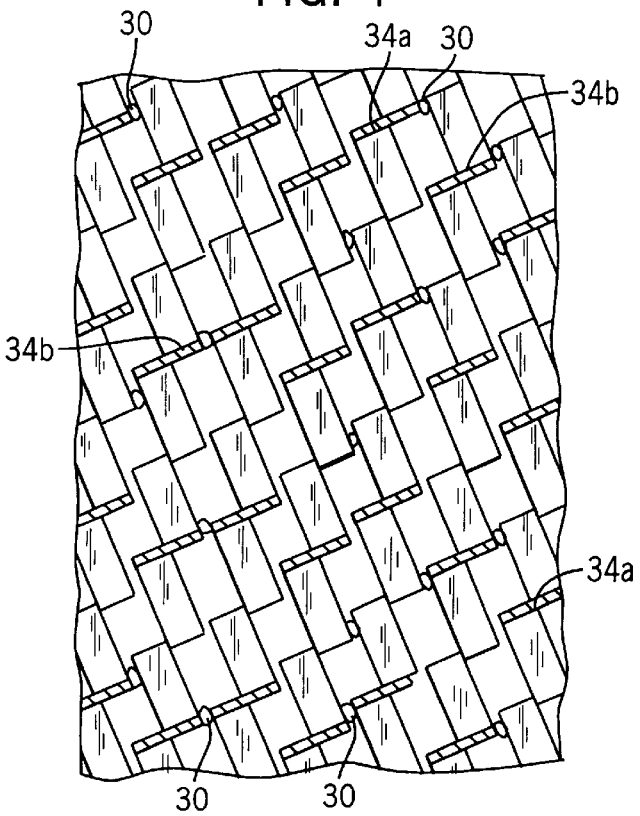
FIG. 4 is a cross-sectional view taken on line 4—4 of FIG. 3.
Figure 5:
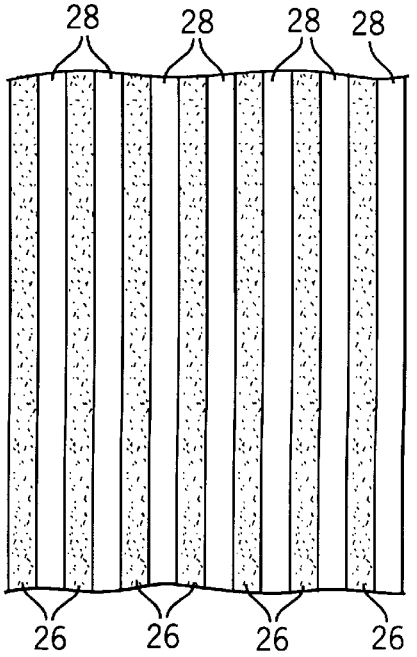
FIG. 5 is a sectional view showing the alternating relationship of layers of wettable kraft paper with wicking paper in the evaporative wicking pad embodying the present invention.

Referring now to the drawings, FIG. 1 illustrates one type of humidifier 10 employing a frame-mounted, gas-liquid contact pad or evaporative element 12 embodying the present invention. Humidifier 10 is a gravity fed device wherein water drips down from a pipe 14 onto the pad 12 from a gutter-like trough or distributor 16 and spreads therethrough. A fan (not shown) forces air through the pad 12 for cooling and humidifying purposes. Any water which drips from the bottom of the pad 12 may be collected in a pan 18 or the like and recirculated if desired. Alternatively, the gas-liquid contact pad or evaporative element 12 may be utilized in other types of humidifiers, such as the wicking-up humidifier 20 shown in FIG. 2, in which the pad 12 is partially immersed in a water bath 22 so that water is wicked up by capillary action. A float valve 24 is normally included in the humidifier 20 to regulate the depth of the water bath 22. Additionally, the evaporative element 12 of the present invention may be employed in a rotating-type humidifier in which a portion of the contact pad is immersed in water and rotated. The gas-liquid contact pad 12 is further adaptable to evaporative coolers.

In accordance with the invention, the contact pad 12 depicted in FIGS. 1 and 2, comprises a plurality of layers of sheets of stacked slit and expanded, water-absorbent or wettable rigidifying paper 26, such as kraft paper, superposed in contiguous, overlying and alternating relationship with a plurality of layers or sheets of stacked slit and expanded, wicking paper 28. The stacked layers or sheets are secured together, preferably by adhesive 30, to define a laminated evaporative element, as more fully described hereafter. A fragment of the pad 12 is shown in FIG. 3, and is formed in a known matter by cutting parallel lines of spaced apart slits in a sheet, the slits of each line being in staggered relationship to those of the adjacent line, and expanding the sheets transversely of the slits to convert the slits into openings. Each sheet 26, 28 when expanded comprises an intersecting grid pattern or network having runners 32*a*, 32*b* intersecting at baffles 34*a*, 34*b* to define a grouping of air spaces or cells 36*a*, 36*b* as is well known. The length of these air cells is typically 15/16 inches, while the width of the air cells is typically 11/15 inches. A plurality of the expanded sheets 26, 28 are arranged in superposed relation to form a reticulate body of water-permeable material in which the planes of the alternating sheets 26, 28 are preferably parallel to the broad end surfaces of the contact pad 12. The sheets are preferably arranged in a manner such that the cells 36*a* of one sheet 26 do not necessarily coincide with the cells 36*b* of the other sheet 28, that is, the sheets 26, 28 are generally staggered so that is webs or baffles 34*a* of the sheets 26 are in line with the cells 36*b* between baffles 34*a*, 34*b* of immediately adjacent sheets 26, 28. By planularly expanding the cells 36*a*, 36*b* of adjacent layers 26, 28, a slightly different amount, the layers 26, 28 are maintained in an unnested condition so that the available area for air-water impingement is maximized.

An extremely important aspect of the invention resides in the particular alternating combination of paper materials used to fabricate the laminated evaporative element. It has been found from laboratory testing that two types of water-absorbent or wettable, rigidifying kraft paper preferably furnished of 47% unbleached soft wood and 53% bleached hard wood are desirable for providing one of the pad materials exhibiting the necessary wicking action while providing the necessary structural rigidity to allow the pad to be self-supporting. In performing such testing, the wicking-up humidifier of FIG. 2 is employed in connection with a laminated evaporative element typically 7⅜ inches wide by 15½ inches long by 3¾ inches deep comprised of 14 layers 26 of kraft paper alternated with 14 layers 28 of wicking paper immersed in ⅝ inches of water, i.e. each layer 26 of kraft paper is followed by a layer 28 of wicking paper to form a pad 28 layers thick disposed in water bath 22.

In one test, each layer or sheet 26 of kraft paper has a basis weight of 35 to 120 lbs., preferably 41 lbs., and is resin-impregnated with a small amount (i.e. 3%) of binder to improve its wet strength. Basis weight is a recognized term of art which signifies the weight of a particular type of paper over a standard 3000 square foot area (24 in×36 in×500 sheets). Accordingly, in the one test, the preferred basis weight is 41 lbs. per 3000 square feet. Tests have shown that this 3% resin-impregnated kraft paper has a Klemm strip rise of approximately 22 mm per 2 minutes and a Bay West absorption time of 90 seconds. The evaporative efficiency of the 3% resin-impregnated kraft paper 26 in this test is 10%.

In a second test, each layer or sheet of kraft paper 26 has a basis weight of 35 to 190 lbs., preferably 120 lbs., and is resin-impregnated with a small amount (e.g. 15%) of melamine formaldehyde to improve its wet strength. Tests have shown that this 15% resin-impregnated kraft paper 26 has a Klemm strip rise of 35 mm per 2 minutes and a Bay West absorption time of 16 seconds. The evaporative efficiency of the 15% resin-impregnated kraft paper 26 is 29%.

Laboratory testing has also demonstrated that the other pad material to be employed in fabrication of the evaporative element is wicking paper 28, having a furnish preferably of 55% alpha bleached soft wood, 20% bleached soft wood and 25% bleached hard wood. Each layer or sheet 28 of wicking paper has a basis weight of 50 to 120 lbs., preferably 70 lbs., and may include a binder coating of 4% to improve its wet strength. Tests have shown that the wicking paper 28 has a Klemm strip rise of 100 mm per 2 minutes and a Bay West absorption time which is so small that absorption is virtually instantaneous. The evaporative efficiency of the wicking paper 28 in the humidifier of FIG. 2 is 56.1%.

As noted above, the alternating layers of kraft paper 26 and wicking paper 28 may be secured and held together preferably by localizing and applying hot melted adhesive 30 to the edges of the runners 32*a,* 32*b* and baffles 34*a,* 34*b* of each layer in a manner which will not impair the evaporative ability and gas permeability of the composite pad 12. As a result of the uniting of the superposed, alternating sheets, adhesive 30 holds the layers 26, 28 together to define the laminated evaporative element 12 so that water may travel from one adjacent sheet to another by a wicking action.

As taught in assignee's U.S. Pat. No. 3,092,442 the gas-liquid contact pad 12 may be manufactured such that the air emanating from the pad will be essentially odorless and the laminated pad 12 will be essentially free of microorganisms, while still maintaining its water absorbency and wicking properties. This is accomplished in the case of both kraft papers 26 by treatment of their pulp with limited quantities of a solubilized emulsion of copper-8-quinolinolate. To further resist microorganisms, the wicking paper may be treated with an anti-microbial agent.

The laminated control pads 12 thus formed are highly effective for the purpose of bringing large surfaces of water into contact with the air for producing rapid evaporation thereinto while maintaining the structural rigidity of the paper layers. The pads 12 are extremely pervious and offer little resistance to the air flow of air passing therethrough. Being composed of interstitial networks of thin, flat, narrow webs which have their broad, flat surfaces disposed at oblique angles with respect to the general direction of flow of air through the pad, turbulence at the surfaces provides efficient wiping action to continuously pickup and carry away moisture-laden air at the interface. The web surfaces are continuously soaked and, by a wicking or capillary action, the water is caused to spread uniformly throughout the layers. As water is continuously carried away, it is replenished by migration from the portions of the pad 12 upon the surfaces of the network by wicking action to keep all surfaces wet. The expanded pattern provides a uniform porosity throughout the area of the pad 12, and the air is brought into thorough, uniform contact with the liquid through the reticulate body of the pad 12.

The laminated pad exhibits an additional desirable property which is unexpected. As normally used, a pad comprised exclusively of 3% resin-impregnated kraft paper 26 has an evaporative efficiency when used in a wick-up type humidifier 20, of 10%. A pad comprised exclusively of 15% resin-impregnated kraft paper 26 has an evaporative efficiency of 54.8% when tested in a gravity feed humidifier. As might be expected, a pad 12 comprised exclusively of wicking paper 28 has a higher evaporative efficiency of 56.1%. Heretofore, if one desired a laminated evaporative element 12 having suitable wickability with structural integrity at low cost, the liquid contact pads made solely with the 3% or 15% resin-impregnated kraft paper layers 26 were generally chosen in favor of an evaporative element 12 constructed only from wicking paper 28 which, while being superior in wickability, is much weaker in dimensional stability and costs appreciably more.

It has been found that combining a series of layers 26 of water-absorbent or wettable rigidifying paper, such as kraft paper, with a series of layers 28 of wicking paper in superposed, alternating relationship produces a laminated evaporative element having evaporative efficiency which is substantially greater than the expected average of the evaporative efficiency of the kraft paper and wicking paper. In fact, this evaporative efficiency has been found to be 46.3% for the combination 3% resin-impregnated kraft paper and wicking paper contact pad 12 when tested in wick-up type humidifier 20. This value is greater than the expected average of the 3% resin-impregnated kraft paper (10%) and the wicking paper (56.1%) which is about 33%. The evaporative efficiency for the combination 3% resin-impregnated kraft paper and wicking paper has been found to be 62.2% when tested in a gravity feed humidifier 10. This value is greater than the expected average of the 3% resin-impregnated kraft paper (50.3%) and the wicking paper (67.1%) which is about 58.7%. In comparison, the evaporative efficiency for a contact pad 12 comprised of alternating layers of a metallic slit and expanded reinforcing material (e.g. aluminum) and wicking paper, when tested in a wick-up type humidifier, was found to be only 31.5%. It has also been found that the addition of wicking paper 28 in alternating, overlying layers with water absorbing or wettable kraft paper 26 helps water to be transferred horizontally in addition to wicking-up, or running downwardly as in a gravity feed humidifier.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

We claim:

1. A gas pervious liquid-gas contact pad comprising a reticulate body of wettable material having a large area of surfaces exposed, said contact pad comprising:

a plurality of slit and expanded sheets of wicking material, each of said sheets of wicking material having a first evaporative efficiency;

a plurality of slit and expanded sheets of wettable kraft material, each of said sheets of kraft material having a second evaporative efficiency; and means for connecting said sheets of wicking and wettable kraft material in superposed and alternating relationship with one another to define a laminated, self-supporting, evaporative element having a combined evaporative efficiency which is substantially greater than the average of said first evaporative efficiency and said second evaporative efficiency.

2. The contact pad of claim 1, wherein the composition of said wicking material is substantially 55% alpha bleached soft woods, 20% bleached soft woods and 25% bleached hard woods.

3. The contact pad of claim 1, wherein the composition of said kraft material is substantially 47% soft woods and 53% hard woods.

4. The contact pad of claim 1, wherein the basis weight of said wicking material is 70 lbs. per 3000 sq. ft.

5. The contact pad of claim 1, wherein the basis weight of said kraft material is 41 lbs. per 3000 sq. ft.

6. The contact pad of claim 1, wherein the basis weight of said kraft material is 120 lbs. per 3000 sq. ft.

7. The contact pad of claim 1, wherein said kraft material is resin-impregnated.

8. The contact pad of claim 1, wherein said kraft material includes a binder.

9. The contact pad of claim 1, wherein said wicking material has a Klemm strip rise of about 100 mm per 2 min.

10. The contact pad of claim 1, wherein said kraft material has a Klemm strip rise of 22 mm per 2 min.

11. The contact pad of claim 1, wherein said kraft material has a Klemm strip rise of 35 mm per 2 min.

12. An evaporative element for a humidifier of the wicking up and gravity feed types comprising:

a series of stacked layers of slit and expanded wicking paper, each of said layers of said wicking paper having a first evaporative efficiency;

a series of stacked layers of slit and expanded wettable kraft paper, each of said layers of kraft paper having a second evaporative efficiency; and adhesive means for securing said layers of wicking paper and wettable kraft paper together in contiguous, overlying and alternating relationship with one another to define a laminated evaporative element having a combined evaporative efficiency which is substantially greater than the average of said first evaporative efficiency and said second evaporative efficiency.

13. The evaporative element of claim 12, wherein each of said layers of wicking paper and said kraft paper has a Klemm strip rise, the Klemm strip rise of said wicking paper being greater than the Klemm strip rise of said kraft paper.

14. The evaporative element of claim 12, wherein said first evaporative efficiency is 56.1%.

15. The evaporative element of claim 12, wherein said second evaporative efficiency is 29%.

16. The evaporative element of claim 12, wherein said second evaporative efficiency is 10%.

17. The evaporative element of claim 12, wherein the combined evaporative efficiency is 62.2%.

18. An evaporative element used in a humidifying device, said element comprising:

a plurality of stacked slit and expanded sheets of wicking paper, each sheet having a first evaporative efficiency;

a plurality of stacked slit and expanded sheets of wettable, wickable rigidifying paper supporting said sheets of wicking paper, each sheet of rigidifying paper having a second evaporative efficiency; and adhesive means for securing said sheets of wicking paper and said rigidifying paper together in superposed, alternating relationship to form a laminated, self-supporting evaporative element having a combined evaporative efficiency which is substantially greater than the average of said first evaporative efficiency and said second evaporative efficiency.

* * * * *